US006796819B2

(12) United States Patent
Chen et al.

(10) Patent No.: US 6,796,819 B2
(45) Date of Patent: Sep. 28, 2004

(54) PORTABLE APPARATUS WITH INWARD-PUSHING TRIGGERED MECHANISM FOR EJECTING ADD-ON DEVICE

(75) Inventors: Yu-Yuan Chen, Taipei Hsien (TW); Hung-Cheng Lee, Taipei Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/605,612

(22) Filed: Oct. 14, 2003

(65) Prior Publication Data

US 2004/0106314 A1 Jun. 3, 2004

(30) Foreign Application Priority Data

Oct. 21, 2002 (TW) ..... 91124269 A

(51) Int. Cl.[7] ..... H01R 13/62
(52) U.S. Cl. ..... 439/160; 429/100
(58) Field of Search ..... 439/160, 152, 439/155; 361/683; 429/100, 96

(56) References Cited

U.S. PATENT DOCUMENTS 4,031,295 A * 6/1977 Rigazio ..... 439/160
4,498,047 A * 2/1985 Hexamer et al. ..... 439/152
4,750,890 A * 6/1988 Dube et al. ..... 439/152
5,768,098 A * 6/1998 Murayama ..... 361/727
6,200,147 B1 * 3/2001 Lan ..... 439/152
6,224,405 B1 * 5/2001 Eland ..... 439/160
6,333,858 B1 * 12/2001 Yun et al. ..... 439/447
6,373,693 B1 * 4/2002 Seto et al. ..... 361/685
6,724,616 B2 * 4/2004 Kuo et al. ..... 361/683

* cited by examiner

*Primary Examiner*—Ross Gushi
*Assistant Examiner*—Briggitte Hammond
(74) *Attorney, Agent, or Firm*—Winston Hsu

(57) ABSTRACT

A portable apparatus with a mechanism for ejecting an add-on device contained in a socket of the portable apparatus. In a preferred embodiment, the ejecting mechanism comprises two engaging parts that can respectively rotate by rotating along two pivots, and a flexible band connected between the two engaging parts for engaging with the add-on device with a contact surface. When a user pushes the two engaging parts toward the socket, an opposite end across the pivot of each engaging part will move outward from the socket, and the flexible band will be stretched and eject the add-on device.

8 Claims, 16 Drawing Sheets

PORTABLE APPARATUS WITH INWARD-PUSHING TRIGGERED MECHANISM FOR EJECTING ADD-ON DEVICE

BACKGROUND OF INVENTION

1. Field of the Invention

The present invention relates to a portable apparatus, and more particularly, to a portable apparatus with an inward-pushing triggered mechanism for ejecting an add-on device.

2. Description of the Prior Art

Nowadays, all kinds of information, data, and documents can be quickly and conveniently stored, managed, and broadcasted in digital form. Therefore, various types of information processing apparatuses for storing digital data have become imperative tools in our information society. In accordance with recent technical developments, the size and weight of the information processing apparatuses have been reduced significantly allowing them to be easily carried with the users. Many apparatuses, including mobile phones, personal digital assistants (PDAs), or notebook computers are widely used.

For expanding and enlarging the functions of the portable apparatus, the portable apparatus usually operates with all kinds of add-on devices. For instance, the portable apparatus includes the battery devices to provide electric power for operations. The modern battery device is designed as a modular add-on device so that the users can remove and install the battery device by themselves to expand the operating time of the portable apparatus. In addition, other add-on devices, such as the memory card that can enlarge the capacity for storing electronic data and the wireless network card that can access the wireless network with the notebook, are also designed as the modular add-on devices to let the users install those add-on devices on the portable apparatus depending on various demands, or to let the users remove those add-on devices from the portable apparatus. For detachably installing these add-on devices, the portable apparatus are also designed with corresponding assistant mechanism, so that on the one hand the add-on devices can be fixed in the portable apparatus, and on the other hand the add-on devices can be easily removed by the corresponding assistant mechanism when the users want to remove the add-on devices.

Please refer to the FIG. 1. FIG. 1 is a schematic diagram of an add-on device 14 and an ejecting machine 20 in the portable apparatus 100 of the prior art. In the present embodiment, the portable apparatus 10 is a mobile phone, and the add-on device 14 can be a battery. The ejecting machine 20 can be used to eject the add-on device 16. As shown in FIG. 1, the mobile phone 10 is covered by housings 12A and 12B. The housing 12B comprises a socket 16 for accommodating the battery 14. The ejecting machine 20 can be made by flexible plastic, and the ejecting machine 20 comprises two engaging parts 22A and 22B installed along the horizontal direction (along the direction as an arrowhead 32 shows). Two shaft bores 26A, 26B installed on the two engaging parts 22A and 22B respectively correspond to two pivots 28A, 28B installed on the housing 12B, so that the two engaging parts 22A and 22B can be rotatably installed in one side of the socket 16. There is a banding part connected between the two engaging parts 22A and 22B, and a protruding part of the banding part forms a contact face 16. When the battery 14 is installed in the socket 16, a bottom of the battery 14 will adjoin a bottom 18 of the socket 16. Moreover, the contact face 16 is co-planar with the bottom 18 of the socket 16, and the contact face 16 will contact an adjoining face 31 of the bottom of the battery 14.

Please refer to FIG. 2. FIG. 2 is a schematic diagram showing all the components of the mobile phone 10 after the battery 14 is installed in the mobile phone 10 (for the sake of clarity, the housing 12A is not shown in FIG. 2). The attached figure, FIG. 2B, is a three-dimensional diagram showing the battery 14 installed in the socket 16 and the attached figure, FIG. 2A, is a cross-sectional diagram of FIG. 2 along the cross line 2A—2A (dotted line 33 is used for marking the position of the side view of the battery 14). The attached figure, FIG. 2C, further describes the condition as shown in FIG. 2A by neglecting the housing 12B and the battery 14. When the battery 14 is installed in the socket 16, the bottom 18 of the socket 16 is co-planar with the contact face 16 of the ejecting machine 20, and the bottom 18 of the socket 16 will adjoin the bottom of the battery 14.

When the user wants to take the battery 14 from the socket 16, the user can push two engaging parts of the ejecting machine 20 outward from the socket 16, and the ejecting machine 20 will eject the battery 14 to let the user conveniently take out the battery 14. Please refer to FIG. 3. FIG. 3 is a schematic diagram showing all the components of the mobile phone 10 when the battery 14 is ejected from the mobile phone 10. The attached figure, FIG. 3B, is a three-dimensional diagram showing the battery 14 ejected from the socket 16, and the attached figure, FIG. 3A, is a cross-sectional diagram of FIG. 3 along the cross line 3A—3A (dotted line 33 is used for marking the position of the side view of the battery 14). The attached figure, FIG. 3C, clearly describes the operations of the ejecting machine 20 by neglecting the housing 12B and the battery 14 as shown in FIG. 3B. When the user wants to take out the battery 14, the user can push the two engaging parts 24A and 24B outward from the socket 16 (namely the direction as an arrowheads 36*a* and 36*b* show) to respectively rotate those two engaging parts 24A and 24B along the pivots 28A and 28B, and the banding part between those two engaging parts 24A and 24B will be lifted upward (namely the direction as an arrowhead 34 shows). The contact face 16 will separate one side of the battery 14 from the bottom 18 of the sockets 16 to let the user conveniently take out the battery 14.

A disadvantage of the above-mentioned prior art is that the user has to simultaneously push both of the engaging parts 22A and 22B of the ejecting machine 20 outward from the socket 16 to trigger the ejecting machine 20 for ejecting the battery 14. Regarding ergonomics, it is hard for the user to simultaneously move both of the engaging parts with a single hand. Therefore, in the prior art, the user must hold the housing 12B with two hands and simultaneously push the engaging parts 22A and 22B respectively with the thumbs of the left and right hands to trigger the ejecting machine 20 for ejecting the battery 14. Regarding all kinds of situations related to forcing with various gestures with fingers, the clamping force with a thumb and a forefinger is larger. In the prior art, since the engaging parts 22A and 22B have to be pushed outward from the socket 16, it is hard for the user to achieve necessary clamping force using fingers of a single hand. Therefore, the user usually has to trigger the ejecting machine 20 with both hands at great inconvenience. Moreover, since the user has to use both hands to install the battery 14 and can hardly control the position of the battery 14 when ejecting the battery 14 with the ejecting mechanism 20, the battery 14 is easily damaged.

In the prior art, the engaging parts of the ejecting machine has to be outwardly triggered so that the user has to trigger the ejecting machine with both hands, leading to inconvenience. Therefore, the ejecting machine of the prior art does not have a good ergonomic design.

SUMMARY OF INVENTION

It is therefore a primary objective of the claimed invention to provide an inward-pushing triggered mechanism for ejecting add-on device to solve the above-mentioned problems of the prior art.

According to the claimed invention, the portable apparatus comprises a housing, a socket installed on the housing for accommodating an add-on device, wherein the socket comprises a bottom formed in horizontal direction, and an ejecting mechanism installed in one side of the socket. The ejecting mechanism comprises an engaging part installed in one end of the socket by rotating along a pivot, wherein the engaging part comprises a first port and a second port respectively installed in the opposite sides of the pivot, a connecting port installed in the other end of the socket opposite to the engaging part so that the second port and the connecting port are respectively installed in the opposite ends of the bottom, a flexible band installed along the horizontal direction, wherein one end of the flexible band is connected to the second port of the engaging part, and the other end of the flexible band is connected to the connecting port. The flexible band comprises a contact face that is installed between the two ends of the flexible band, and the add-on device comprises a joint face corresponding to the contact face. When the add-on device is installed inside that socket, position of the joint face of the add-on device corresponds to position of the contact face of the flexible band. When the first port of the engaging part is pushed toward the socket, the engaging part will rotate along the pivot to make the second port is pushed outward from the socket and to straighten the flexible band so that the contact face of the flexible band moves upward along vertical direction and the add-on device will be ejected from the bottom along vertical direction.

In the preferred embodiment of the present invention, the ejecting machine also comprises rotatable engaging parts and flexible bands for providing an inward-pushing mechanism to let the user easily eject the add-on device with a single hand.

These and other objectives of the present invention will no doubt become obvious to those of ordinary skill in the art after reading the following detailed description of the preferred embodiment, which is illustrated in the various figures and drawings.

DETAILED DESCRIPTION

Figure 4A:
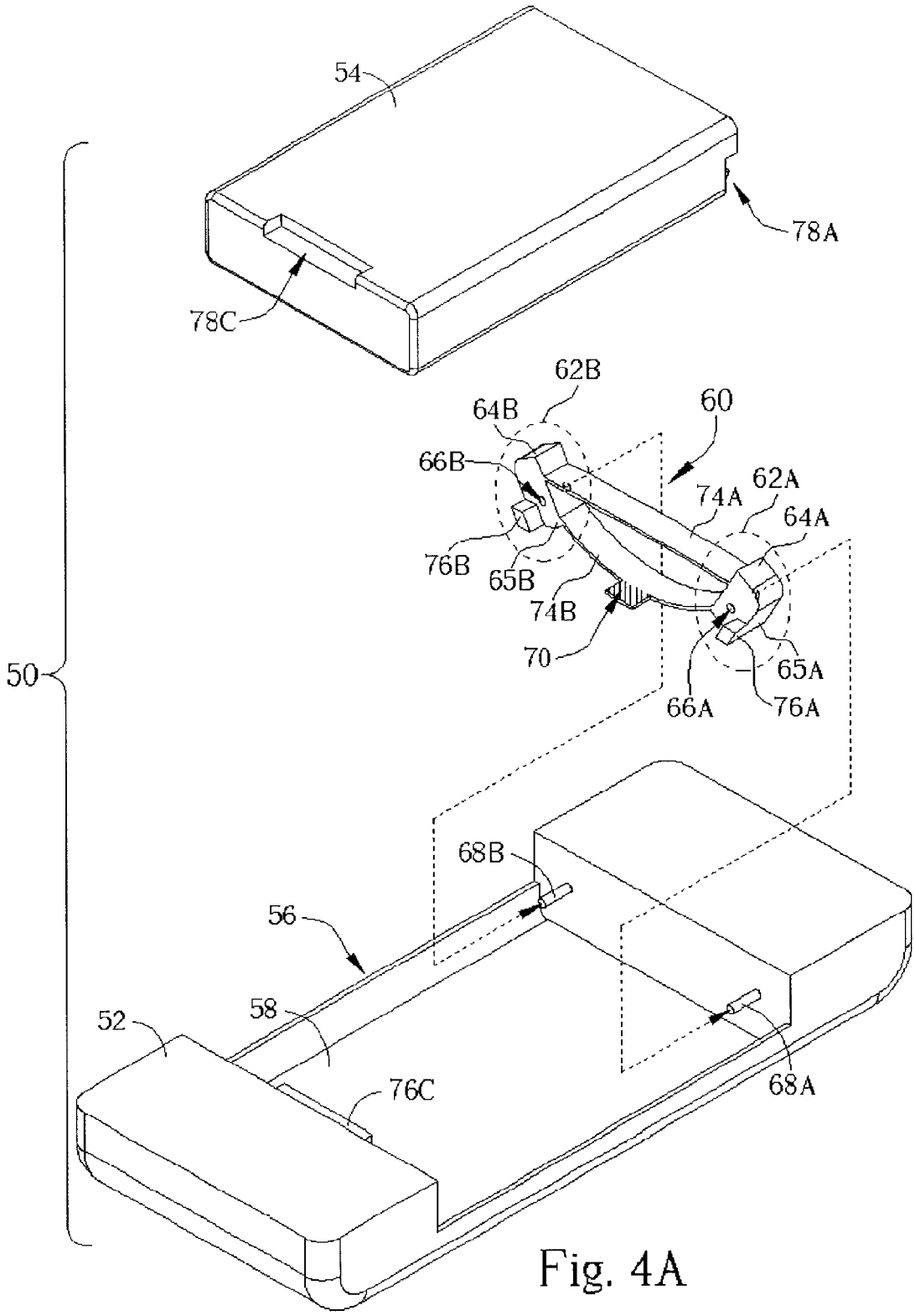
FIG. 4A and FIG. 4B are external-shape diagrams respectively showing all components from different angles in a portable apparatus of a first embodiment of the present invention.
Figure 4B:
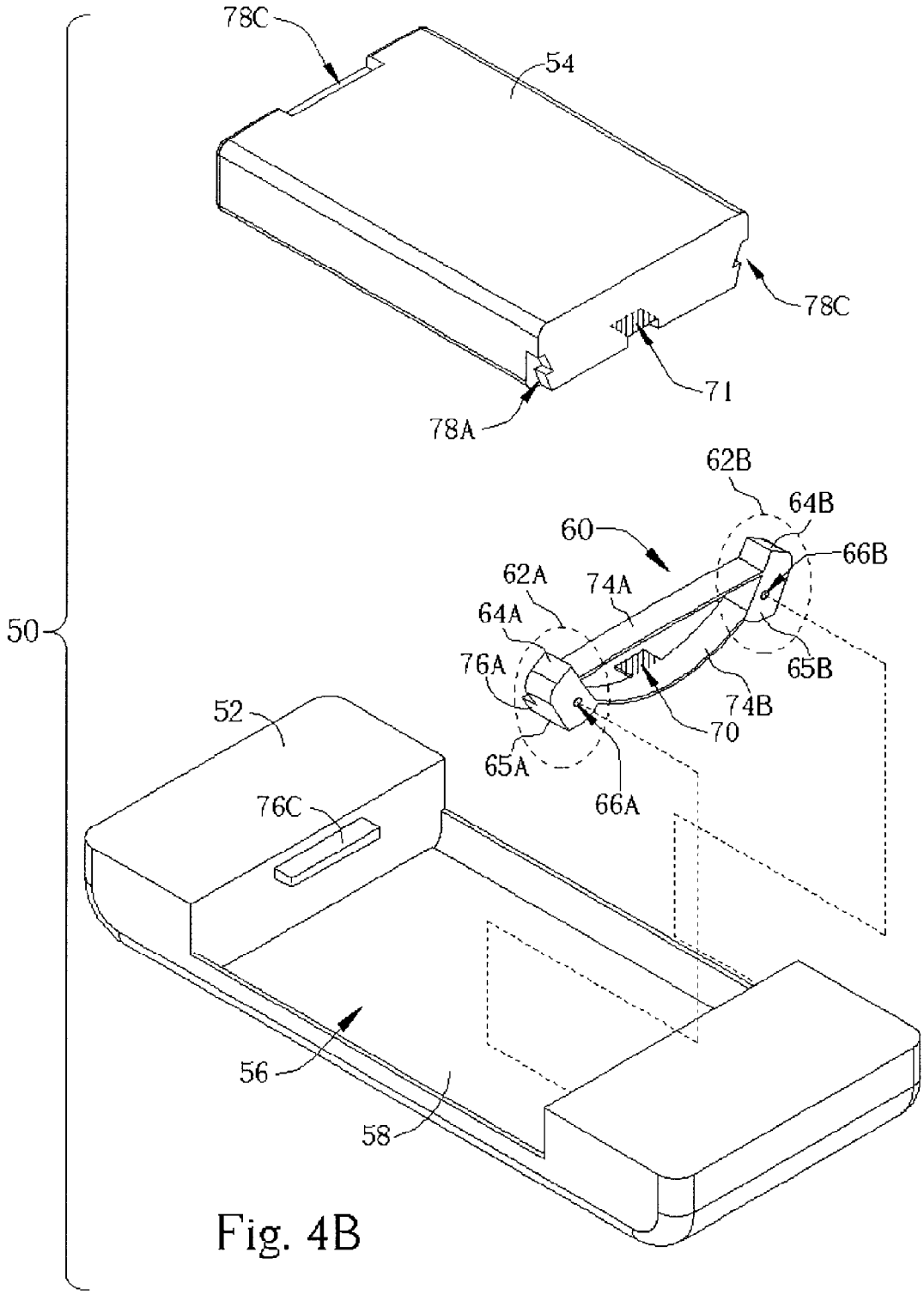

Please refer to FIG. 4A and FIG. 4B. FIG. 4A and FIG. 4B are external-shape diagrams respectively showing all components from different angles in a portable apparatus 50 of a first embodiment of the present invention. The portable apparatus 50 is covered by a housing 52, and the portable apparatus 50 can be a mobile phone, personal digital assistant (PDA), notebook, digital camera, shoot video recorder, walkman, and so on. The housing 52 comprises a socket 56 for accommodating an add-on device 54. The add-on device 54 can be a battery or add-on card that can prolong or enlarge the functions of the portable apparatus 50. In order that the user can conveniently remove the add-on device 54 from the housing 52, the present invention also comprises an ejecting machine 60 installed in one side of the socket 56 like the ejecting mechanism of the portable apparatus 50. When the user triggers the ejecting machine 60, the add-on device 54 can be ejected from the socket 56.

As FIG. 4 shows, two pivots 68A and 68B are respectively installed in two ends of a bottom 58 of the socket 56. As FIG. 4A and FIG. 4B show, the ejecting machine 60 comprises two engaging parts 62A and 62B, and the engaging parts comprise two shaft bores 66A and 66B respectively corresponding to the pivots 68A and 68B of the housing 52 to install the engaging parts 62A and 62B in the housing 52 by rotating along the pivots 68A and 68B. The two opposite sides of the engaging part 62A around the shaft bore 66A can be divided into a triggering port 64A and a connecting port 65A. Similarly, the two opposite sides of the engaging part 62A around the shaft bore 66B can be divided into a triggering port 64B and a connecting port 65B. Between the two triggering ports 64A and 64B, a flexible band 74A is connected to the triggering port 64A and 64B. Between the connecting ports 65A and 65B, a flexible band 74B is connected to the connecting ports 65A and 65B. The flexible band 74B comprises a protruding part for forming a contact face 70. Corresponding to the contact face 70, the add-on device 54 comprises a hollow part, and one side of the hollow part forms an adjoining face 71 as shown in FIG. 4B. In addition, as FIG. 4 shows, two convex structures are respectively installed on the engaging parts 62A and 62B approaching the connecting ports for forming main embedding parts 76A and 76B. One side of the socket 56 also comprises a bulge as shown in FIG. 4B as another main embedding part 76C. Corresponding to the main embedding parts 76A, 76B, and 76C, the add-on devices 54 also comprise sockets for forming corresponding deputy embedding parts 78A, 78B, and 78C.

Figure 5:
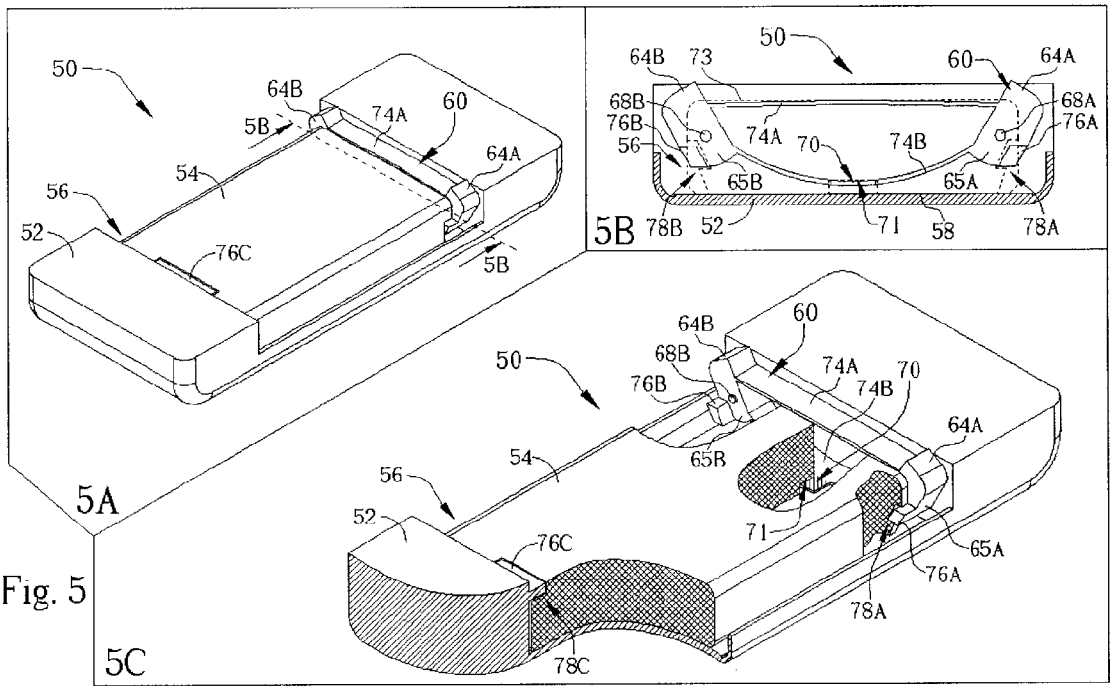
FIG. 5 is a schematic diagram showing all components after an add-on device as shown in FIG. 4A is installed in the portable apparatus as shown in FIG. 4A.

Please refer to FIG. 5. Three attached figures of FIGS. 5, 5A, 5B, and 5C, show all components after the add-on device 54 is installed in the housing 52 of the portable apparatus 50. FIG. 5A is a schematic diagram of the external shape of the portable apparatus 50. FIG. 5B is a cross-sectional diagram along a cross line 5B—5B in FIG. 5A (the dotted line 73 shows the projected contour of one side of the add-on device 54). FIG. 5C further describes the condition in the portable apparatus 50 by neglecting the housing 52 and the add-on device 54. As FIG. 5B and FIG. 5C show, when the add-on device 54 is installed in the socket 56, the contact face 60 of the flexible band 74B can be embedded into the socket of the add-on device 54 and be corresponding to the adjoining face 71. The main embedding parts 76A, 76B, and 76C also respectively correspond to the deputy embedding parts 78A, 78B, and 78C of the add-on device 54 in order to fix the add-on device 54 into the bottom 58 of the socket 56.

Figure 6:
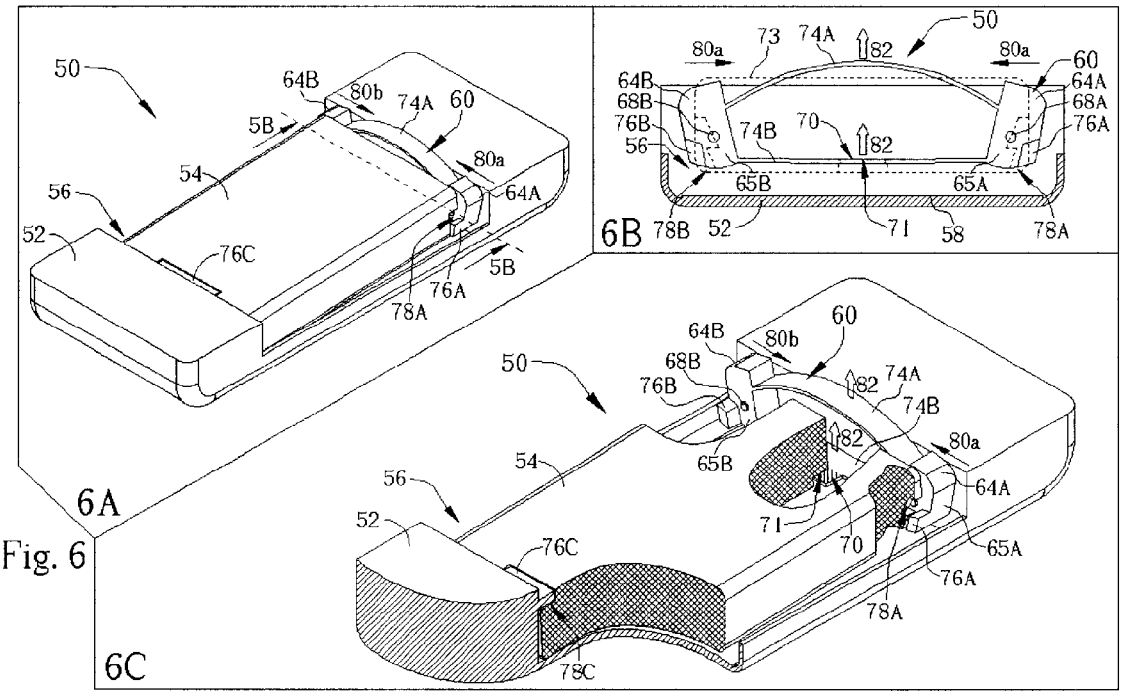
FIG. 6 is a schematic diagram showing all components after the add-on device as shown in FIG. 4A is ejected from the portable apparatus as shown in FIG. 4A.

When the user exerts the clamping force to push the engaging parts inward the socket 56, the ejecting machine 60 can eject one side of the add-on device 54 from the socket 56 for the user to replace the add-on device 54 conveniently. Please refer to FIG. 6. Three attached figures, 6A, 6B, and 6C, are schematic diagrams showing all components after the add-on device 54 is ejected from the socket 56 of the portable apparatus 50. FIG. 6A is a schematic diagram of the external shape of the portable apparatus 50 showing the add-on device 54 being ejected. FIG. 6B is a cross-sectional diagram along a cross line 6B—6B in FIG. 6A (the dotted line 73 shows the projected contour of one side of the add-on device 54). FIG. 6C further describes the condition in the portable apparatus 50 by neglecting the housing 52 and the add-on device 54. As FIG. 6B and FIG. 6C show, when the user pushes the engaging parts 64A and 64B of the ejecting machine 60 inward to the socket 56 (along the direction as arrowheads 80*a* and 80*b* show), the engaging parts 64A and 64B will squeeze the flexible band 74A and lift the flexible band 74A upward. At this moment, the connecting ports 65A and 65B that are opposite to the engaging parts 64A and 64B across the pivots 68A and 68B will move outward from the socket 56 (along the reverse direction as the arrowheads 80*a* and 80*b* show). The flexible band 74B will be straightened, and the contact face 70 of the flexible band 74B will be lifted upward (along the direction as the arrowhead 82 shows). When the contact face 70 of the flexible band 74B is lifted upward, the corresponding adjoining face 71 will be lifted upward, and the add-on device 54 will be lifted to leave the bottom 58 and be ejected from the socket 56. While the connecting ports 65A and 65B move outward, the main embedding parts 76A and 76B also will separate from the corresponding deputy embedding parts 78A and 78B of the add-on device 54. When one side of the add-on device 54 is ejected from the ejecting machine 60, the main embedding part 76C will separate from the deputy embedding part 76C of the add-on device 54 as shown in FIG. 6C to let the user easily take the add-on device 54 from the socket 56.

When the user exerts the clamping force to separate the add-on device 54 from the socket 56 with the ejecting machine 60, the user can relax the force over the engaging parts 64A and 64B. The upward-bent flexible band 74A between these two engaging parts 64A and 64B will relax after the user ceases to exert force, and the engaging parts 64A and 64B will be respectively pushed back to the original positions (the reverse directions as the arrowheads 80*a* and 80*b* show).

Figure 7:
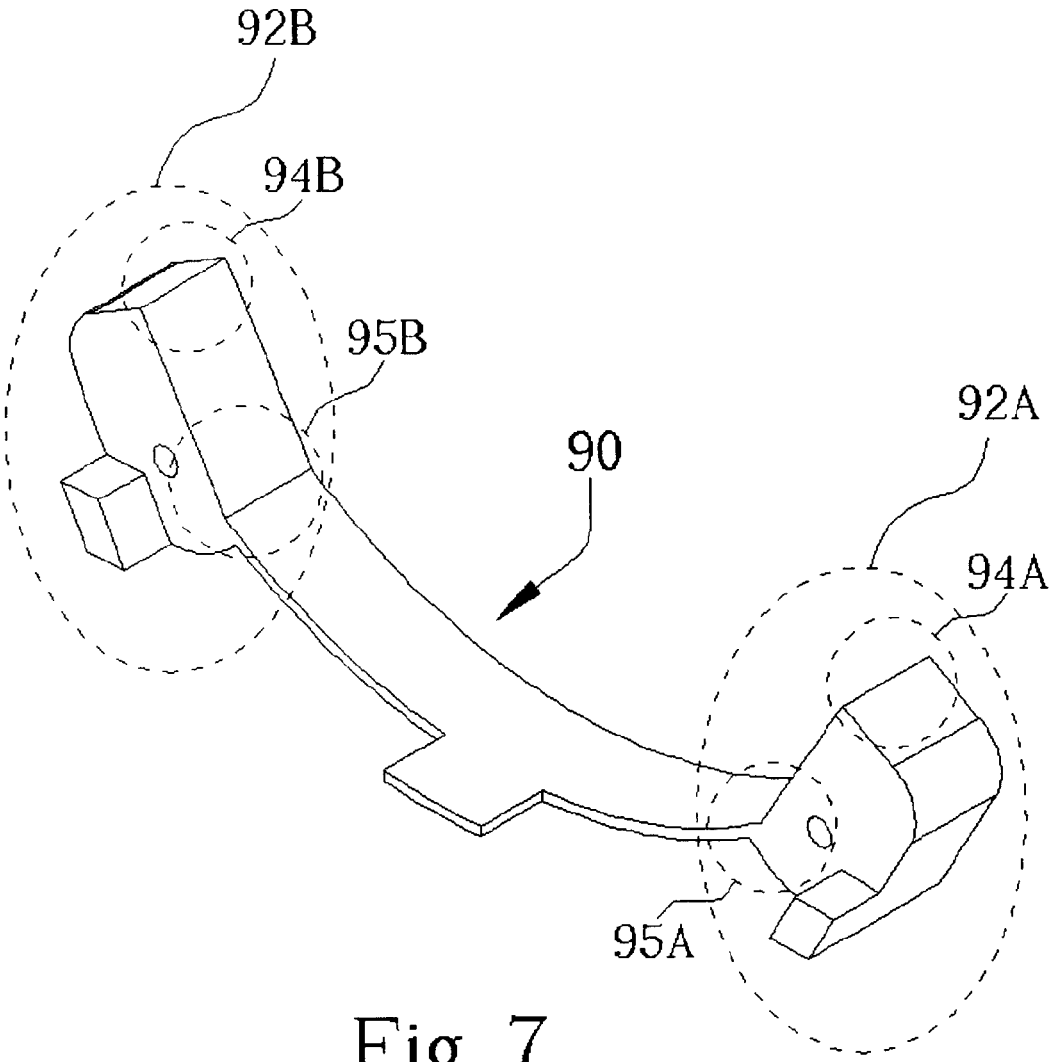
FIG. 7 is a schematic diagram of an ejecting machine of a second embodiment of the present invention.

Please refer to FIG. 7. FIG. 7 is a schematic diagram of an ejecting machine 90 of a second embodiment of the present invention. Compared with the above-mentioned ejecting machine 60, the ejecting machine 90 neglects connecting ports 94A and 94B between the engaging parts 92A and 92B. The ejecting machine 90 preserves only the flexible band between two connecting ports 95A and 95B. The operating principles of the ejecting machine 90 are the same with those of the ejecting machine 60. When these two engaging parts 94A and 94B are pushed inward, the flexible band between the two connecting ports will be straightened to eject the add-on device. If the flexible band between two connecting ports 95A and 95B has great elasticity, the ejecting machine 90 can recover to the original condition after the user relaxes the force even though the flexible band between the engaging parts 94A and 94B is neglected.

Figure 8A:
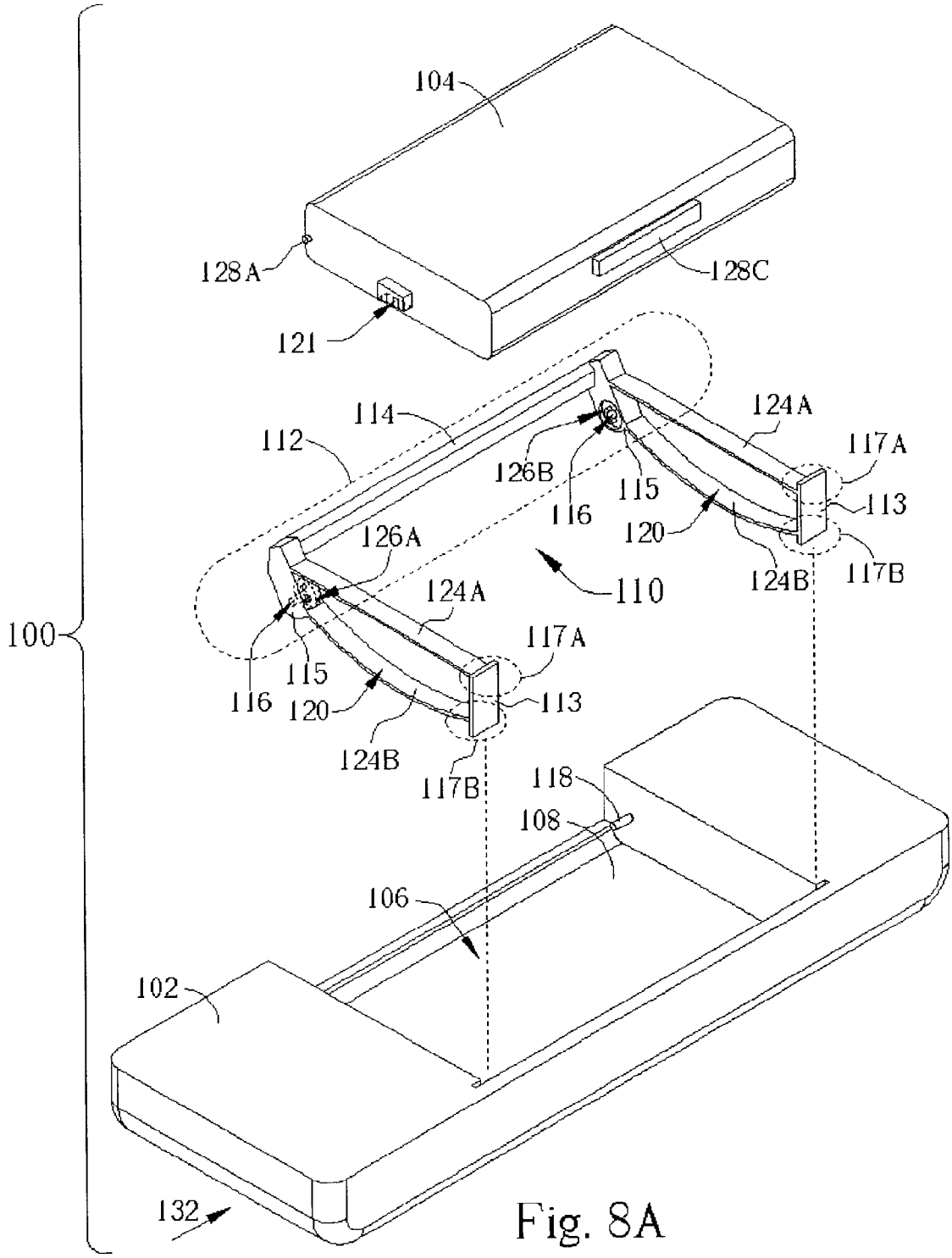
FIG. 8A and FIG. 8B are external-shape diagrams respectively showing all components from different angles in the portable apparatus of a second embodiment of the present invention.
Figure 8B:
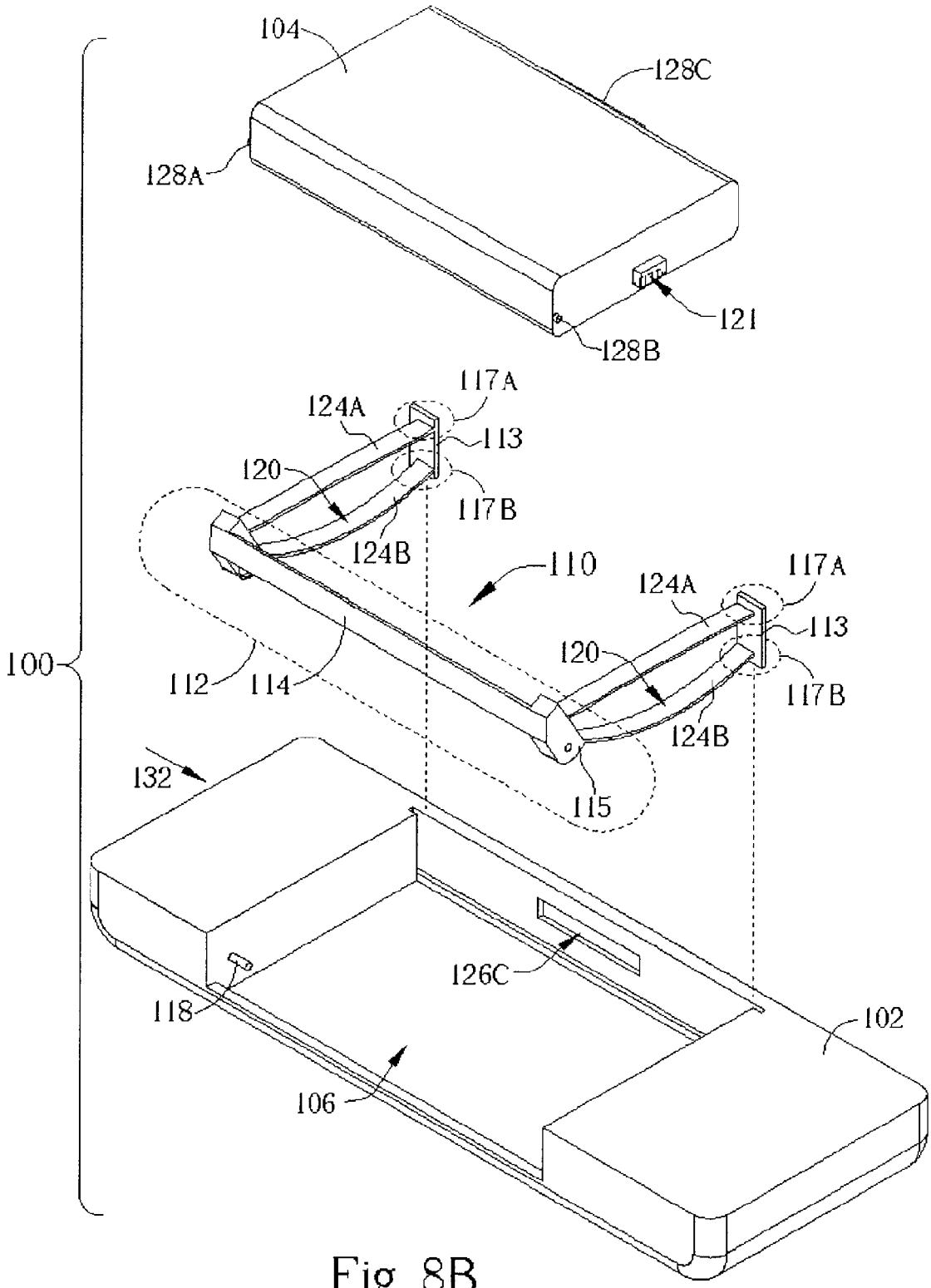

Please refer to FIG. 8A and FIG. 8B. FIG. 8A and FIG. 8B are external-shape diagrams respectively showing all components from different angles in the portable apparatus of a second embodiment of the present invention. The portable apparatus 100 is covered by a housing 102. The housing 102 comprises a socket 106 for accommodating an add-on device 104. The add-on device 104 can be a battery or add-on card that can prolong or enlarge the functions of the portable apparatus 100. In order that the user can conveniently remove the add-on device 104 from the housing 102, the present invention also comprises an ejecting machine 110 installed in one side of the socket 106 as the ejecting mechanism of the portable apparatus 50. Along the bottom 108 of the socket 106, two sides of the socket 106 comprise pivots 118 respectively shown in FIG. 8A and FIG. 8B located at the same axis, and the ejecting machine 110 also comprises an engaging part 112 integrated with a triggering port 114. The engaging part 112 is rotatably installed inside the socket 116 with a shaft bore 116. In the engaging part 112, the opposite side of the triggering port 114 across the shaft bore 116 also forms a connecting port 115. Another side opposite to the engaging part 112 in the ejecting machine 110 forms two connecting ports 117A and 117B with two ends of a fixed part 113. Between the connecting port 117A and the triggering port 114, a flexible band 124A is installed, and between the connecting port 115 and 117B, another flexible band 124B is installed. Different from the engaging part 112 that is rotatably installed inside the socket 116, the fixed part 113 is fixed in another side of the socket 106. Similar to the previous embodiment, the upper side of the flexible band 124B forms a contact face 120. Corresponding to the contact face 120, the two sides of the add-on device 104 form two adjoining faces 121 with convex shape as shown in FIG. 8A and FIG. 8B. In the portable apparatus 100, the main embedding parts 126A and 126B with concave shape are installed on the engaging part 112, and a main embedding part 126C with concave shape is also installed on the inner side of the socket 106 as shown in FIG. 8B. The main embedding parts 126A, 126B, and 126C respectively correspond to the deputy embedding parts 128A, 128Bs, and 128C with convex shape in the add-on device 104. When the add-on devices 104 is installed in the socket 106, the main embedding parts can embedded with the deputy embedding parts to fix the add-on device 104 stationary on the bottom 108.

Figure 9:
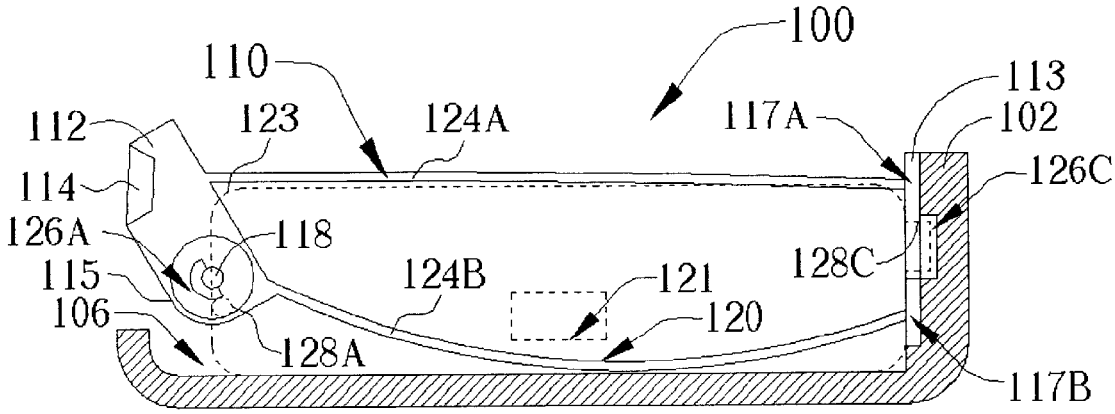
FIG. 9 is a schematic diagram showing all components after an add-on device as shown in FIG. 8A is installed in the portable apparatus as shown in FIG. 8A.
Figure 10:
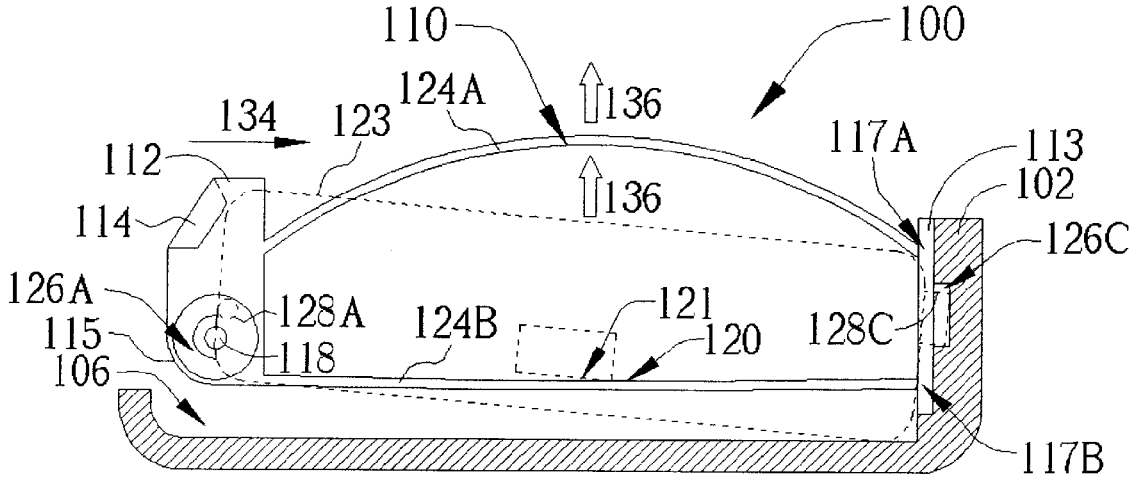
FIG. 10 is a schematic diagram showing all components after the add-on device as shown in FIG. 8A is ejected from the portable apparatus as shown in FIG. 8A.

The operations of the ejecting machine 110 are described in FIG. 9 and FIG. 10. FIG. 9 is a side view showing all components along the direction of arrowhead 132 points at after the add-on device 100 as shown in FIG. 8A is installed in the portable apparatus 104 as shown in FIG. 8A. FIG. 10 is a is a side view showing all components along the direction of arrowhead 132 points at after the add-on device as shown in FIG. 8A is ejected from the portable apparatus as shown in FIG. 8A. When the add-on device 104 that is outlined with the dotted line 123 for marking its position is installed in the socket 106, the projecting position of the adjoining face 121 of the add-on device 104 overlaps the position of the contact face 120 of the flexible band 124B. The main embedding parts 126A, 126B, and 126C respectively correspond to the deputy embedding parts 128A, 128Bs, and 128C with convex shape in the add-on device 104. When the add-on device 104 is installed in the socket 106, the main embedding parts can be embedded with the deputy embedding parts to fix the add-on device 104 on the bottom 108.

As FIG. 10 shows, when the user wants to remove the add-on device 104, the user can exert force to move the triggering port 114 of the engaging part 112 inward (as the direction of arrowhead 134 shows), and the corresponding connecting port 115 will move outward from the socket 106 because of the rotation of the engaging part 112 (the opposite direction of what the arrowhead 134 shows). Afterwards, the flexible band 124B will be stretched, and the contact face 120 will arouse the adjoining face of the add-on device 104 to rise. Therefore, the add-on device 104 can escape from the bottom 108 and be ejected from the socket 106. While the add-on device 104 is lifted, the deputy embedding parts 128A, 128B, and 128C also escape from the main embedding parts 126A, 126B, and 126C on the connecting port 115 and the housing 102 so that the user can conveniently take the add-on device 104. When the user applies force on the triggering port 114 to stretch the flexible band 124B, the flexible band 124A will be compressed and be bended upward. After the user releases the force, the elasticity of the flexible band 124A will push the engaging part 112 back to its original position (along the opposite direction as the arrowhead shows). Certainly, as with the above-mentioned ejecting machines 60 and 90, the present embodiment also can neglect the flexible band 124A installed between the triggering port 114 and the connecting port 117A so that the ejecting machine 110 can be pushed to its original position only by the elasticity of the flexible band 124B.

Figure 11:
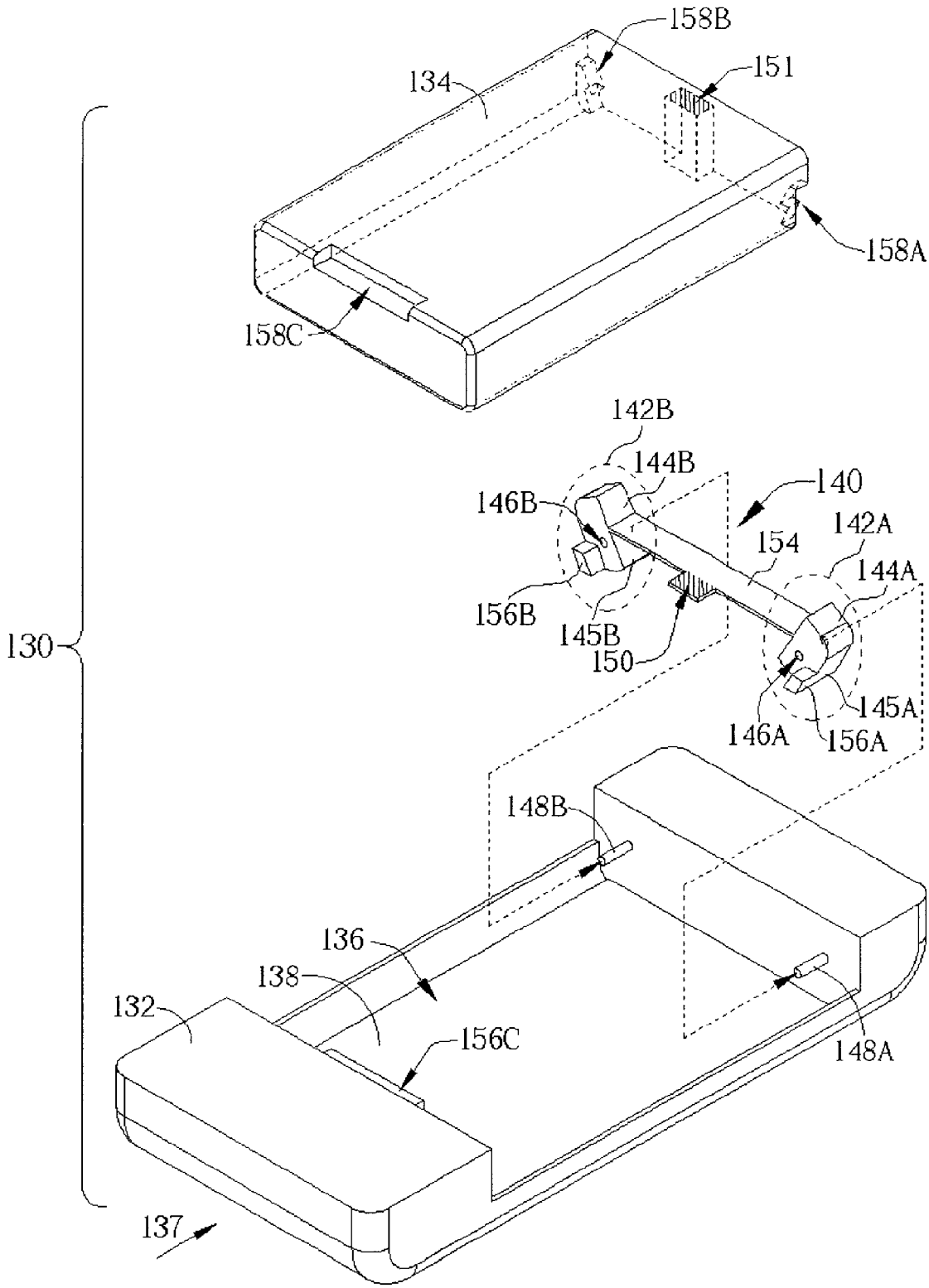
FIG. 11 is an external-shape diagram showing all components in a portable apparatus of a third embodiment of the present invention.

Please refer to the FIG. 11. FIG. 11 is an external-shape diagram showing all components in a portable apparatus 130 of a third embodiment of the present invention. The portable apparatus 130 is covered by a housing 132, and comprises a socket 136 for accommodating an add-on device 134. The present embodiment also comprises an ejecting machine 140 installed in one side of the socket 136 as the ejecting mechanism of the portable apparatus 130. When the user triggers the ejecting machine 140, the add-on device 134 can be ejected from the socket 136. The ejecting machine 140 comprises two engaging parts 142A and 142B, and the engaging parts comprise two shaft bores 146A and 146B respectively corresponding to the pivots 148A and 148B of the housing 132 to install the engaging parts 142A and 142B in the housing 132 by rotating along the pivots 148A and 148B. The two opposite sides of the engaging part 142A around the shaft bore 66A can be divided into a triggering port 144A and a connecting port 145A. Similarly, the two opposite sides of the engaging part 142A around the shaft bore 146B can be divided into a triggering port 144B and a connecting port 145B. Between the two triggering ports 144A and 144B, a flexible band 154 is connected to the triggering port 144A and 144B. The flexible band 154 comprises a protruding part for forming a contact face 150. Corresponding to the contact face 150, the add-on device 134 comprises a hollow part, and one side of the hollow part forms an adjoining face 71 as shown in FIG. 11. In addition, two convex structures are respectively installed on the engaging parts 142A and 142B approaching the connecting ports for forming main embedding parts 156A and 156B. One side of the socket 136 also comprises a bulge as another main embedding part 76C. Corresponding to the main embedding parts 156A,156B, and 156C, the add-on devices 54 also comprises sockets for forming corresponding deputy embedding parts 158A,158B, and 158C for respectively fixing the positions of the main embedding parts 156A, 156B, and 156C.

Figure 12:
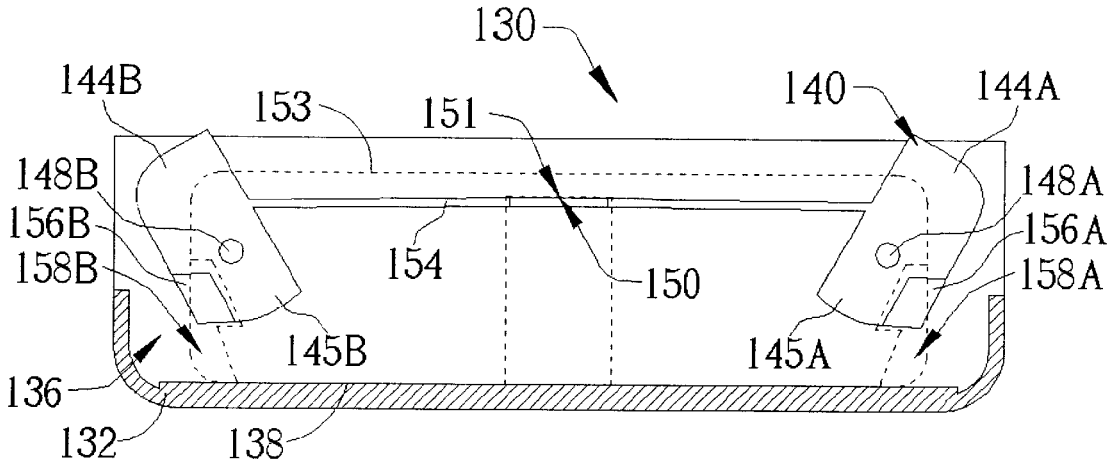
FIG. 12 is a schematic diagram showing all components after an add-on device as shown in FIG. 11 is installed in the portable apparatus as shown in FIG. 11.

Please refer to FIG. 12. FIG. 12 is a side view showing all components along the direction of arrowhead 137 points at after the add-on device as shown in FIG. 11 is installed in the portable apparatus as shown in FIG. 11. When the add-on device 134 that is outlined with the dotted line 153 for marking its position is installed in the socket 136, the main embedding parts, the main embedding parts 156A and 156B can embedded with the deputy embedding parts 158A and 158B to fix the add-on device 134.

Figure 1:
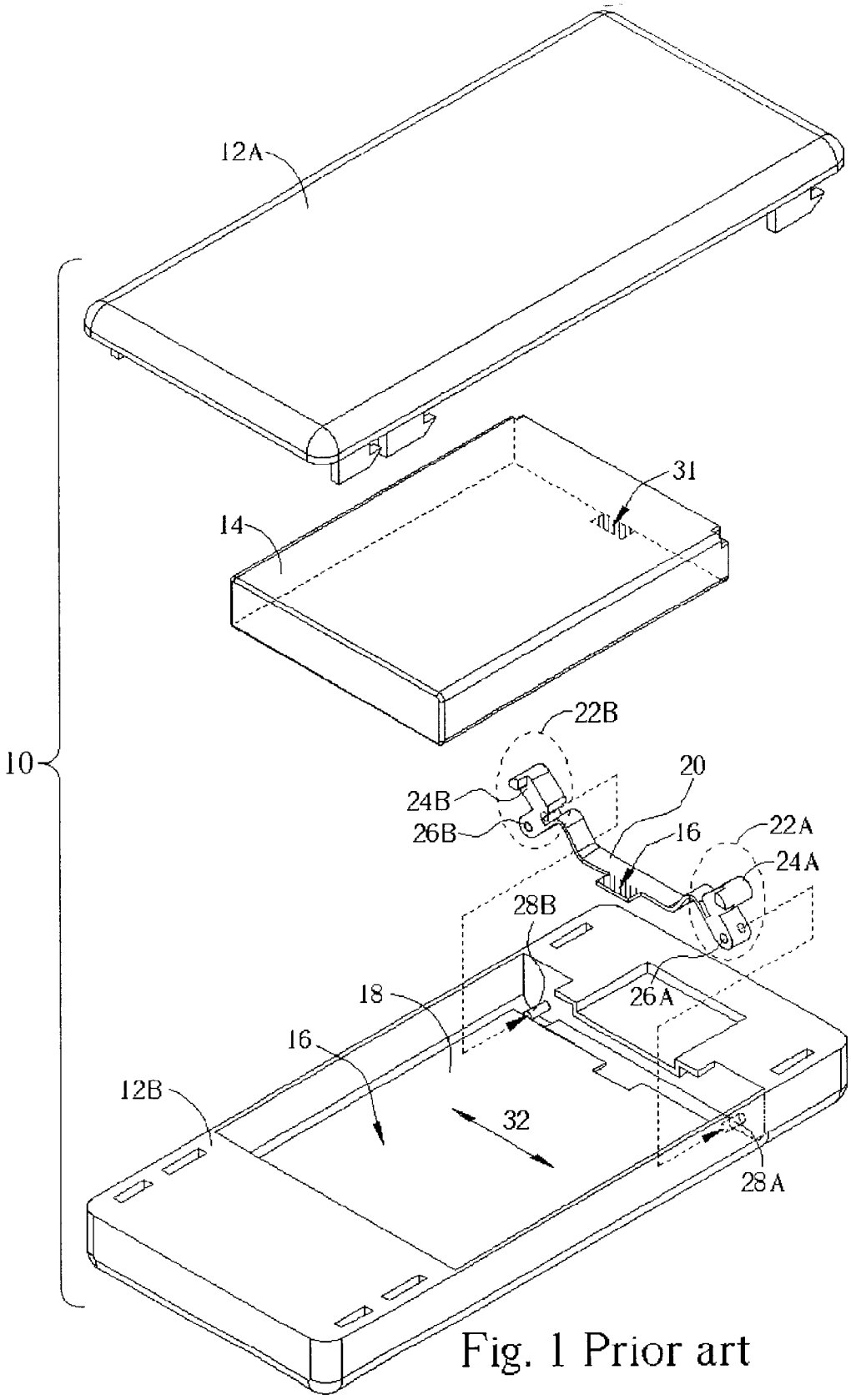
Fig. 1 Prior art
FIG. 1 is a schematic diagram showing all components of a portable apparatus of the prior art
Figure 2:
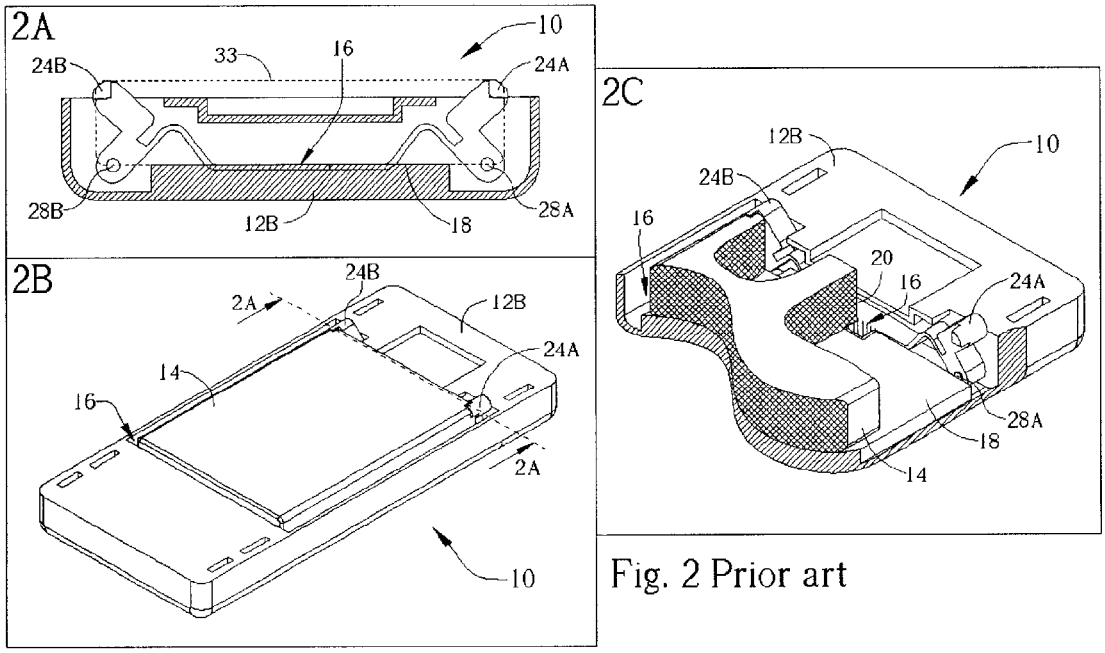
Fig. 2 Prior art
FIG. 2 is a schematic diagram showing all components after an add-on device as shown in FIG. 1 is installed the portable apparatus as shown in FIG. 1.
Figure 3:
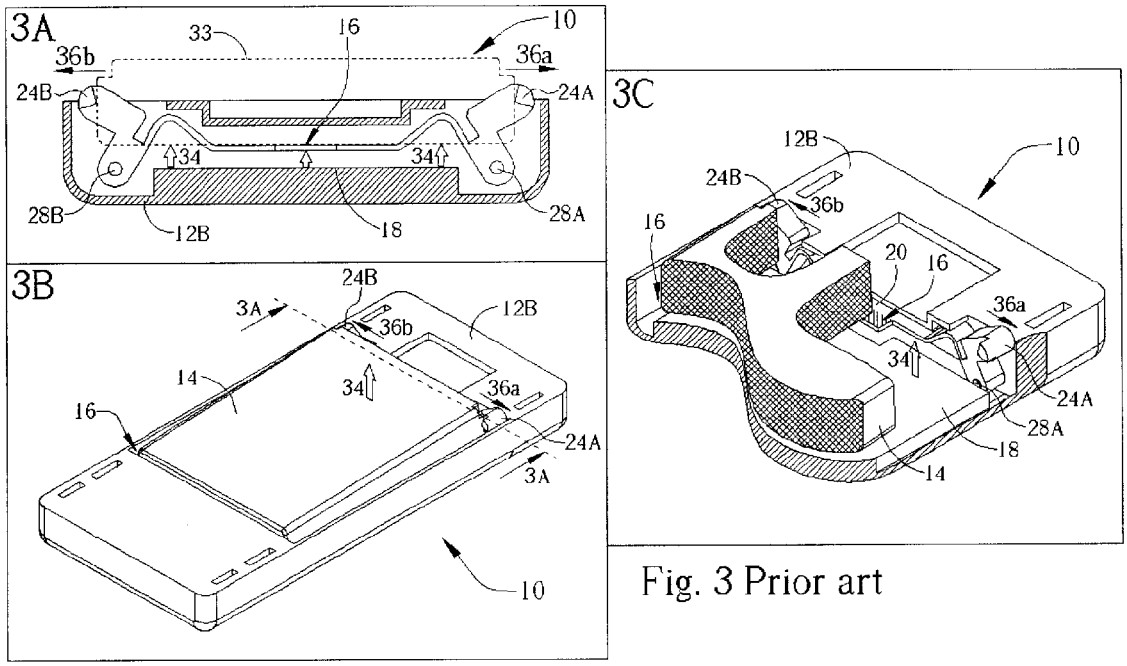
Fig. 3 Prior art
FIG. 3 is a schematic diagram showing all components after the add-on device as shown in FIG. 1 is ejected from the portable apparatus as shown in FIG. 1.
Figure 13:
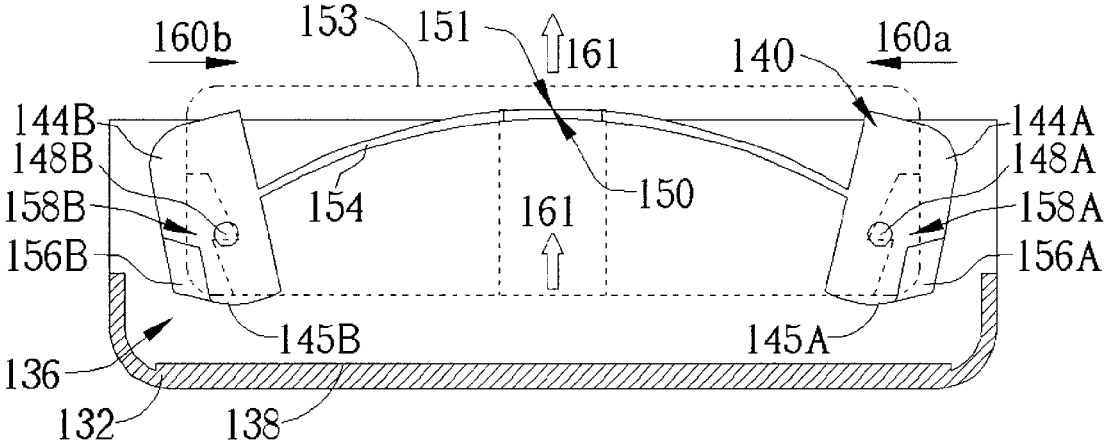
FIG. 13 is a schematic diagram showing all components after the add-on device as shown in FIG. 11 is ejected from the portable apparatus as shown in FIG. 11.

Please refer to the FIG. 13. FIG. 13 is a schematic diagram showing all components after the add-on device as shown in FIG. 11 is ejected from the portable apparatus as shown in FIG. 1. If the user wants to exert the clamping force to trigger the ejecting machine 60 for ejecting the add-on device 54 from the socket 56, the user can apply clamping force to move the engaging parts 64A and 64B inward (respectively along the directions as arrowheads 160*a* and 160*b* show). Then, the flexible band 154 between two engaging parts 144A and 144B will be compressed and be bended upward, and the contact face 150 of the flexible band 154 is also lifted upward (along the direction as arrowhead 161 shows). The adjoining face 151 of the add-on device 134 that is outlined with dotted line 153 is lifted upward to make the add-on device 134 eject the socket 136. After that, the main embedding parts 156A and 156B are not embedded with the deputy embedding parts 158A and 158B so that the user can conveniently remove the add-on device 134. Regarding the assembly and disassembly related to the main embedding part 156C and the deputy embedding part 158C, the operations and principles can refer to FIG. 5 and FIG. 6. The characteristic of the present embodiment is using a compressed and bent flexible band to eject the add-on device, while the previous embodiments as shown in FIG. 4A, FIG. 4B, FIG. 7, and FIG. 8 use a stretched flexible band to eject the add-on device.

The ejecting machine 140 as shown in FIG. 11 to FIG. 13 shows that when the user ejects the add-on device 134 smoothly and releases the applying force on the triggering ports 144A and 144B, the compressed flexible band 154 between two triggering ports 144A and 144B will move along the opposite direction (along the opposite direction as the arrowhead 160*a* and 160*b* in FIG. 13 show) and release the elasticity. Certainly, the present invention also can install a flexible band can between two connecting ports 145A and 145B in the ejecting machine 140.

Figure 14:
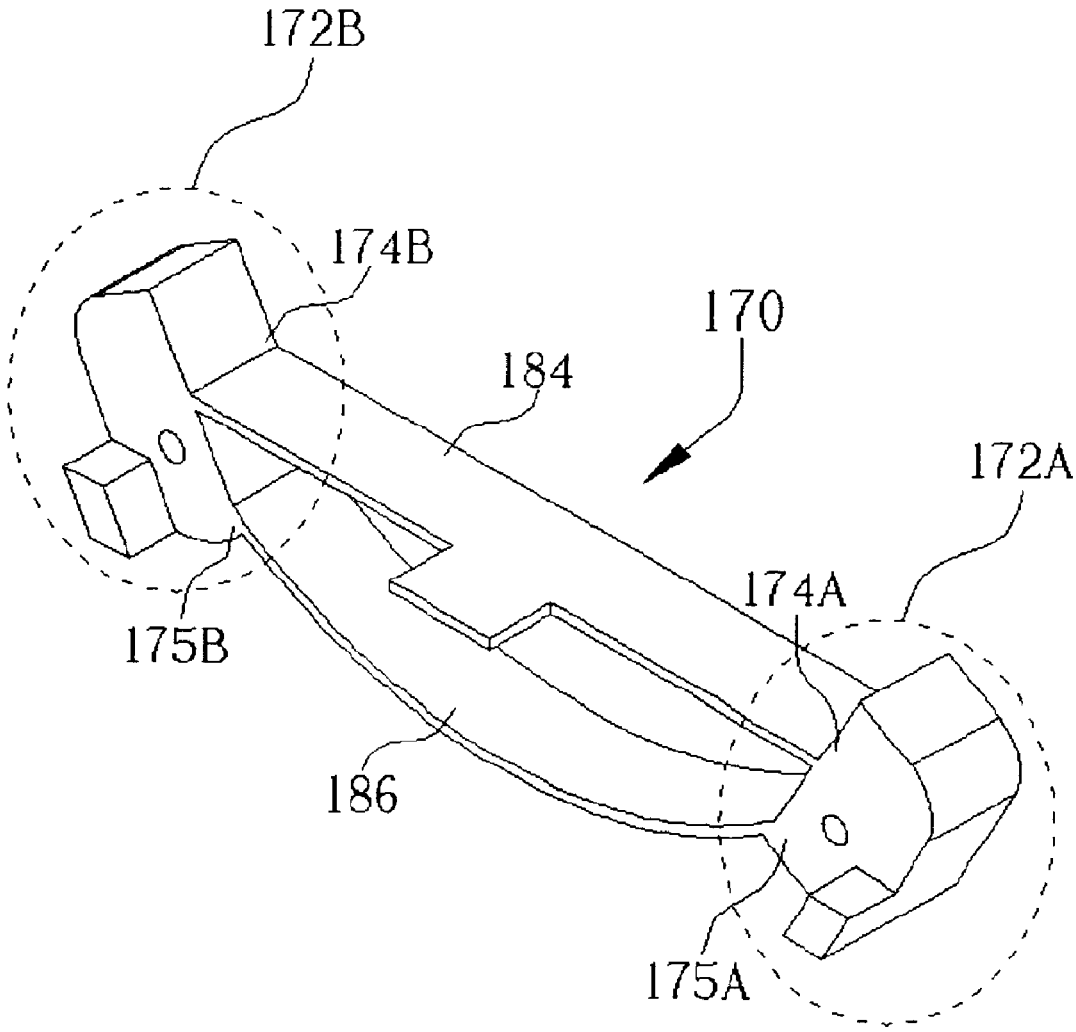
FIG. 14 is a schematic diagram of an ejecting machine of a fourth embodiment of the present invention.

Please refer to FIG. 14. FIG. 14 is a schematic diagram of an ejecting machine 170 of a fourth embodiment of the present invention. The ejecting machine 170 comprises a flexible band 184 between the triggering port 174A and the connecting port 175A, and another flexible band 186 between the triggering port 174B and the connecting port 175B. The ejecting machine 170 also uses a compressed flexible band between two engaging part 172A and 172B to eject the add-on device. Certainly, the ejecting machines 140 and 170 (as shown in the FIGS. 11–14) also can use the structure as shown in FIG. 8A and FIG. 8B to install a rotatable triggering port in one side of the ejecting machine with a fixed connecting port in another side for ejecting the add-on device.

In the prior art, the engaging parts of the ejecting machine has to be outwardly triggered so that the user has to trigger the ejecting machine with both hands with great inconvenience. Therefore, the ejecting machine of the prior art does not have a good ergonomic design. In the preferred embodiments of the present invention, the ejecting machine comprises rotatable engaging parts and flexible bands for providing an inward-pushing mechanism to let the user easily eject the add-on device with a single hand. Therefore, the ejecting machine of the present invention has a good ergonomic design and provides convenience for the users. Moreover, the ejecting machine of the present invention can be manufactured with elastic rubber or plastic or be assembled by the engaging parts and the flexible bands with different materials.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A portable apparatus, the portable apparatus comprising:

a housing;

a socket installed on the housing for accommodating an add-on device, wherein the socket comprises a bottom formed in a horizontal direction; and an ejecting mechanism installed in one side of the socket, the ejecting mechanism comprising:

an engaging part installed in one end of the socket by rotating along a pivot, wherein the engaging part comprises a first port and a second port respectively installed in opposite sides of the pivot;

a second engaging part installed in one end of the socket by rotating along a second pivot so that the engaging part and the second engaging part are respectively installed in the opposite end of the bottom, wherein the second engaging part comprises a third port and a fourth port respectively installed in opposite sides of the second pivot, wherein the fourth port is installed in another end of the socket opposite to the engaging part so that the second port and the fourth port are respectively installed in the opposite ends of the bottom; and a flexible band installed along the horizontal direction, wherein one end of the flexible band is connected to the second port of the engaging part, and another end of the flexible band is connected to the fourth port; the flexible band comprising a contact face that is installed between the two ends of the flexible band; the add-on device comprising a joint face corresponding to the contact face;

wherein when the add-on device is installed inside the socket, a position of the joint face of the add-on device corresponds to position of the contact face of the flexible band, and when the first port and the third port are pushed toward the socket at the same time, the engaging part will rotate along the pivot to make the second port push outward from the socket and the second engaging part will rotate along the second pivot to make the fourth port move outward from the socket to straighten the flexible band so that the contact face of the flexible band moves upward along a vertical direction and the add-on device will be ejected from the bottom along the vertical direction.

2. The portable apparatus of claim 1 further comprising: a second flexible band installed along the horizontal direction, wherein one end of the second flexible band is connected to the first port, and another end of the second flexible band is connected to the third port; when the first port and the third port are pushed toward the socket at the same time, the second flexible band will be compressed and generate a reverse force to push the first port and the third port outward from the socket.

3. The portable apparatus of claim 1 wherein the socket further comprises a main embedding part, and the add-on device further comprises a deputy embedding part; when the add-on device is installed inside the socket, the main embedding part is embedded with the deputy embedding part to fix the add-on device inside the socket; when the first port and the third port are pushed toward the socket to make the second port and the fourth port move outward from the socket, the main embedding part will be aroused to separate from the deputy embedding part.

4. The portable apparatus of claim 1 wherein the portable apparatus is a mobile phone, and the add-on device is a battery for providing power supply for operations of the portable apparatus.

5. The portable apparatus of claim 1 wherein the portable apparatus is a notebook, and the add-on device is a battery for providing power supply for operations of the portable apparatus.

6. The portable apparatus of claim 1 wherein the second port further comprises a main embedding part, and a deputy embedding part is installed in the corresponding position of the add-on device; when the add-on device is installed inside the socket, the main embedding part is embedded with the deputy embedding part to fix the add-on device inside the socket; when the first port and the third port are pushed toward the socket to make the second port and the fourth port move outward from the socket, the main embedding part will be aroused to separate from the deputy embedding part.

7. The portable apparatus of claim 6 wherein the main embedding part is a bulge hook installed in the second port, and the deputy embedding part is a corresponding socket.

8. The portable apparatus of claim 6 wherein the deputy embedding part has a convex shape, and the main embedding part is a socket installed in the second port.

* * * * *